United States Patent [19]

Vlerebome

[11] 4,121,360

[45] Oct. 24, 1978

[54] IDENTIFICATION BRACELET

[76] Inventor: June S. Vlerebome, 574 W. 44 Pl., Hileah, Fla. 33012

[21] Appl. No.: 830,428

[22] Filed: Sep. 6, 1977

[51] Int. Cl.[2] ..... G09F 7/00

[52] U.S. Cl. ..... 40/586; 63/2; 40/21 C

[58] Field of Search ..... 40/586, 21 R, 21 C; 63/2, 15

[56] References Cited

U.S. PATENT DOCUMENTS

| | | | |
|---|---|---|---|
| 1,486,850 | 3/1924 | Avery et al. | 40/21 R |
| 1,517,456 | 12/1924 | Pulliam | 40/21 C |
| 2,641,074 | 6/1953 | Richmond | 40/21 C |
| 3,214,852 | 11/1965 | Ford et al. | 40/21 C |
| 3,242,540 | 3/1966 | Mitchell | 63/2 |
| 3,269,041 | 8/1966 | Marcus | 40/21 R |

*Primary Examiner*—Louis G. Mancene
*Assistant Examiner*—Wenceslao J. Contreras
*Attorney, Agent, or Firm*—Robert D. Farkas

[57] ABSTRACT

An identification apparatus for infants utilizes a pair of elastic bands fabricated from a rubber-like material each having different peripheral lengths. The larger band is adapted for engagement about the wrist of an infant, while the smaller band engages an index finger of the infant. The elastic bands are joined by an elongated transparent strap having the ends thereof fastened to the bands. An elongated sheet of paper-like material is secured within a cavity formed by folding over each elongated marginal edge of the strap so as to have indicia carried by a lateral surface of the flexible sheet exposed through the transparent strap residing on the hand of the infant extending over the knuckles.

5 Claims, 4 Drawing Figures

IDENTIFICATION BRACELET

BACKGROUND OF THE INVENTION

1. The Field of the Invention

This invention relates to identification bracelets and more particularly to that class removably affixed without destruction, to the wrist and finger of an infant.

2. Description of the Prior Art

The prior art abounds with identification bracelets suitable for attachment to portions of the human anatomy. U.S. Pat. No. 2,954,620 issued on Oct. 4, 1960 to J. D. Schneider, is typical of most identification devices adapted for attachment to the wrist of a user. An elongated strap, preferably fabricated from a transparent flexible material has a sheet inserted in a pocket thereof such that the sheet is captured within the pocket exposed having an open mouth portion at one end of the strap. The strap is affixed about the wrist of a user having the ends of the strap fixedly secured to one another utilizing a crimping tool. A cutting operation is required to remove the strap from the user. Such devices similar to that of Schneider, present constantly recurring problems. These entail the use of a specific tool to fasten the ends or portions of the length of the strap adjacent the ends together, a cutting operation so as to remove the strap, and a strap which tends to slide about the wrist of the user, so that the indicia carried by the paper-like material is not easily viewed in a location at the outermost portion of the wrist of the user.

SUMMARY OF THE INVENTION

A primary object of the present invention is to provide an identification band for infants which are easily removed and easily fastened to the wrist and finger of the infant.

Another object of the present invention is to provide a band which displays the indicia portion thereof at a fixed location which can be easily read at all times.

Still another object of the present invention is to provide an identification band whose indicia portion extends beyond the restricted circumference of the wrist of the infant.

Yet another object of the present invention is to provide an identification band which can be used over and over again without destruction.

A further object of the present invention is to provide an identification band whose indicia portion can be removed, after use, and be provided with a new indicia carrying portion at low cost.

A still further object of the present invention is to provide a novel and inexpensively fabricated identification device which disposes the indicia along a longitudinal line parallel to the longitudinal axis of the forearm of the infant.

Heretofore indicia bands were secured to portions of the human anatomy, such portions generally being the wrists or ankles of an infant. Most infants have wrists of small diameter thereby prohibiting the use of identification bands containing indicia that is easily read by the infant's attendants. Furthermore, infants tend to move or flail their arms about in such a fashion that a wrist or ankle band would tend to have the indicia bearing portions thereof obscured from view. Infants also tend to maintain their arms in an upright position, when awake, so as to make the reading of a wristband difficult along the peripheral length thereof. The present invention takes into account such problems by providing a band which is easily removed and affixed to the hand or wrist portions of an infant such that the indicia portion of the apparatus is exposed and running parallel to the longitudinal axis of the infant's arm and may be of substantially greater length than a portion of the perimeter of a wrist band. Because the band need not be cut the present invention may be utilized over again for various infants. There is no tool required to secure the present invention band to the arm of the infant, thereby enhancing the use of the apparatus of the invention, in emergency situations. This requirement is especially essential for infants who would be otherwise unable to identify themselves, as compared to adults.

DESCRIPTION OF THE PREFERRED EMBODIMENT

Figure 1:
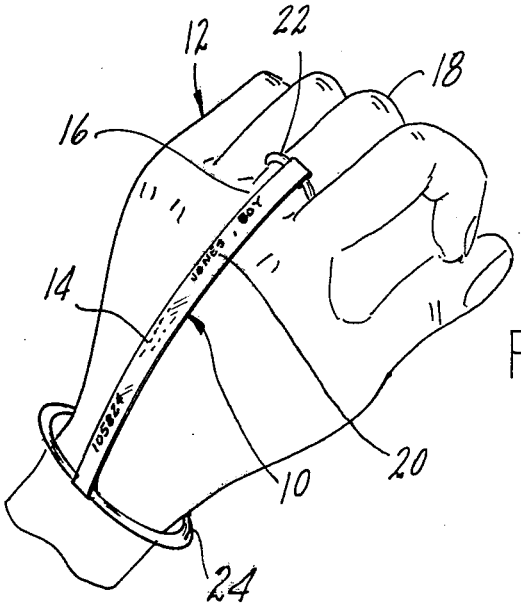
FIG. 1 is a perspective view of the present invention shown being installed on the hand and forearm of an infant user.

The structure and method of fabrication of the present invention is applicable to a pair of elastic bands one of which has a smaller diameter than the other. The elastic bands can be made from a rubber-like material similar to a rubber band. The larger band is of such size as to be easily slipped over the hand of an infant and resides wrapped around the wrist of an infant user, whilst the smaller band has a sufficient size easily to be inserted over the index finger of an infant. Both bands are joined together by a transparent flexible strap fabricated from a material preferably polyvinylchloride. Such strap has an elongated shape wherein the long marginal edges are folded over, over a lateral surface of the strap so as to have the elongated marginal edges of the strap disposed in parallel relationship closely spaced apart. The ends of the transparent strap are secured to the elastic bands as by the process of heat sealing, or if preferred, by folding the ends of the band over and utilizing an adhesive or solvent to fasten the ends of the band to the exterior surface of the apparatus adjacent the cavity formed between the surface and the marginal edges aforementioned. An elongated sheet material, preferably fabricated from paper or cardboard, is inserted between the slit formed between the adjacent elongated marginal edges of the strap. The sheet is adapted to have indicia on the lateral surface such that the lateral surface is exposed passing through the surface of the strap opposite the location of the elongated marginal edges. In use, the larger elastic band is first slipped about the fingers of the hand of the infant such that when the band is almost at the wrist location the smaller elastic band is engaged over the distal end of the index finger of the infant. Concurrent moving of the elastic bands towards the elbow of the arm permits the apparatus to be installed in an operating location such that the larger band is wrapped about the wrist of the infant and the smaller band is placed on the third digit of the index finger. In such a location the indicia carried by a flexible sheet is exposed on the outermost surface of the band and located crossing over a knuckle of the infant.

Now referring to the Figures showing the present invention 10 shown installed on the hand 12 of an infant such that the elongated strap portion 14 is disposed covering the knuckle 16 of the index finger 18 of the infant. Indicia 20 is visibly accessible through strap 14. Band 22 is shown wrapped about index finger 18 whilst larger band 24 is shown installed encircling wrist 26 of the infant.

Figure 2:
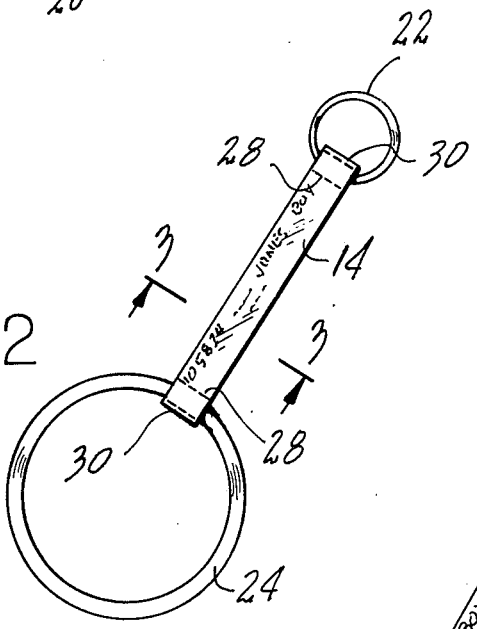
FIG. 2 is a plan view of the present invention.

FIG. 2 shows elastic band 24 and elastic band 22 secured to strap 14 by having seals 28 disposed closer to the center portion of strap 14 than seals 30, located at the ends of strap 14. Seals 28 and 30 may be supplanted by adhesive regions, not shown, so as to form pockets encircling the band.

Figure 3:
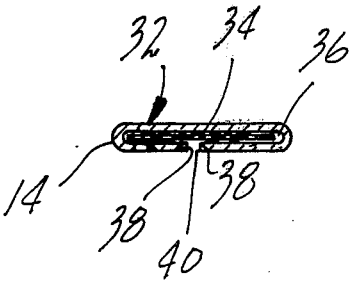
FIG. 3 is a cross-sectional side elevational view, viewed in the direction of arrows 3—3, along lines 3—3, of the apparatus shown in FIG. 2.

FIG. 3 illustrates a portion of strap 14 having surface 32 thereof continuous and overlying a flexible sheet 34 contained within cavity 36. Elongated marginal edges 38 are shown slightly spaced apart so as to provide slit 40, used to insert flexible sheet 34 within cavity 36.

Figure 4:
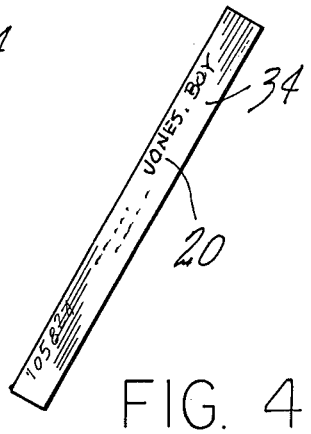
FIG. 4 is a plan view of the elastic sheet portion of the present invention.

FIG. 4 illustrates elongated flexible sheet 34 having indicia 20 thereon.

One of the advantages of the present invention is an identification band for infants which are easily removed and easily fastened to the wrist and finger of the infant.

Another advantage of the present invention is a band which displays the indicia portion thereof at a fixed location which can be easily read at all times.

Still another advantage of the present invention is an identification band whose indicia portion extends beyond the restricted circumference of the wrist of the infant.

Yet another advantage of the present invention is an identification band which can be used over and over again without destruction.

A further advantage of the present invention is an identification band whose indicia portion can be removed, after use, and be provided with a new indicia carrying portion at low cost.

A still further advantage of the present invention is a novel and inexpensively fabricated identification device which disposes the indicia along a longitudinal line on the outermost surface of the band and located crossing over a knuckle of the infant.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

I claim:

1. An identification apparatus for infants comprising a pair of elastic endless bands, one of said pair of elastic bands having a smaller peripheral length than the other of said pair of elastic bands, an elongated strap, said strap fabricated from a transparent flexible material, one end of said strap fixedly secured to said one of said pair of elastic bands, the other end of said elongated strap fixedly secured to the other of said pair of elastic bands, an elongated sheet, said elongated sheet fabricated from a flexible material, means to secure said elongated sheet to said elongated strap, said elongated sheet for carrying indicia on at least one lateral surface thereof.

2. The apparatus as claimed in claim 1 wherein said means to secure said elongated sheet comprises said elongated strap having a cavity therein, said cavity formed by a pair of marginal edges of said elongated strap being disposed parallel to one another and located adjacent one lateral surface of said elongated strap.

3. The apparatus as claimed in claim 1 comprising said pair of elastic bands being fabricated from a rubber-like material.

4. The apparatus as claimed in claim 1 comprising said elongated strap fabricated from polyvinylchloride.

5. The apparatus as claimed in claim 1 wherein said elongated sheet comprises a paper-like material.

* * * * *